US010787797B2

(12) United States Patent
Akins

(10) Patent No.: US 10,787,797 B2
(45) Date of Patent: Sep. 29, 2020

(54) ODOR VENTING WELL PUMP SYSTEM

(71) Applicant: Jack Akins, Coffeeville, AL (US)

(72) Inventor: Jack Akins, Coffeeville, AL (US)

( * ) Notice: Subject to any disclaimer, the term of this patent is extended or adjusted under 35 U.S.C. 154(b) by 200 days.

(21) Appl. No.: 16/149,106

(22) Filed: Oct. 1, 2018

(65) Prior Publication Data

US 2019/0100901 A1 Apr. 4, 2019

Related U.S. Application Data

(60) Provisional application No. 62/565,663, filed on Sep. 29, 2017.

(51) Int. Cl.

| | |
|---|---|
| ***E03B 3/16*** | (2006.01) |
| ***E03B 5/04*** | (2006.01) |
| ***E21B 43/32*** | (2006.01) |

(52) U.S. Cl.

CPC ..... *E03B 3/16* (2013.01); *E03B 5/04* (2013.01); *E21B 43/32* (2013.01)

(58) Field of Classification Search

CPC ..... E21B 21/00; E21B 43/00; E21B 43/32; E03B 3/16; E03B 5/04

See application file for complete search history.

(56) References Cited

U.S. PATENT DOCUMENTS 2,833,222 A * 5/1958 Hansen ..... E21B 43/38 166/105.5
4,290,979 A * 9/1981 Sugiura ..... B01F 3/04099 209/170
4,444,259 A * 4/1984 Schwall ..... C02F 1/20 166/105
4,543,186 A * 9/1985 Weisenbarger ..... C02F 1/481 210/170.06
5,104,554 A * 4/1992 Dempsey ..... C02F 1/20 210/170.07
5,851,389 A * 12/1998 Brewster ..... B01D 24/008 210/264
7,048,861 B2 * 5/2006 Beretta, III ..... C02F 1/74 210/139
7,100,683 B2 * 9/2006 Heilmann ..... B01F 3/04262 166/68
7,650,938 B2 * 1/2010 Hall ..... B01F 3/04496 166/235
8,286,951 B2 * 10/2012 Dart ..... B01F 3/04517 166/177.7
8,845,906 B2 * 9/2014 Henley ..... C02F 9/00 204/267

(Continued)

*Primary Examiner* — Daniel P Stephenson

(57) ABSTRACT

An odor venting water pump system uses an air pump to agitate well water within a well enclosure in order to separate unpleasant smelling gases from the well water. A water pump is positioned at the bottom of a well enclosure and surrounded by well water received into the well enclosure from the surrounding ground water supply. An air tube is connected to an air pump and a terminal end of the air tube is positioned at the lower end of a venting pipe which has an inlet to accept well water. The pumped air agitates the water within the venting pipe and pushes the air/water mixture upwards through the venting pipe to an outlet, where the water returns to the main water supply while the odious gases are free to exit the well enclosure through an air vent at the upper end of the well enclosure.

10 Claims, 1 Drawing Sheet

(56) References Cited

U.S. PATENT DOCUMENTS

| | | | | |
|---|---|---|---|---|
| 8,956,532 | B1 * | 2/2015 | James, Jr. | C02F 1/74 210/167.01 |
| 9,139,457 | B2 * | 9/2015 | Hatten | C02F 1/727 |
| 10,450,211 | B1 * | 10/2019 | Julian | E03B 5/06 |
| 2004/0244974 | A1 * | 12/2004 | Zupanick | E21B 43/305 166/267 |
| 2012/0224994 | A1 * | 9/2012 | Steiner | B01D 53/346 422/3 |
| 2013/0161262 | A1 * | 6/2013 | Henley | C02F 9/00 210/695 |
| 2019/0100901 | A1 * | 4/2019 | Akins | E03B 5/04 |

* cited by examiner

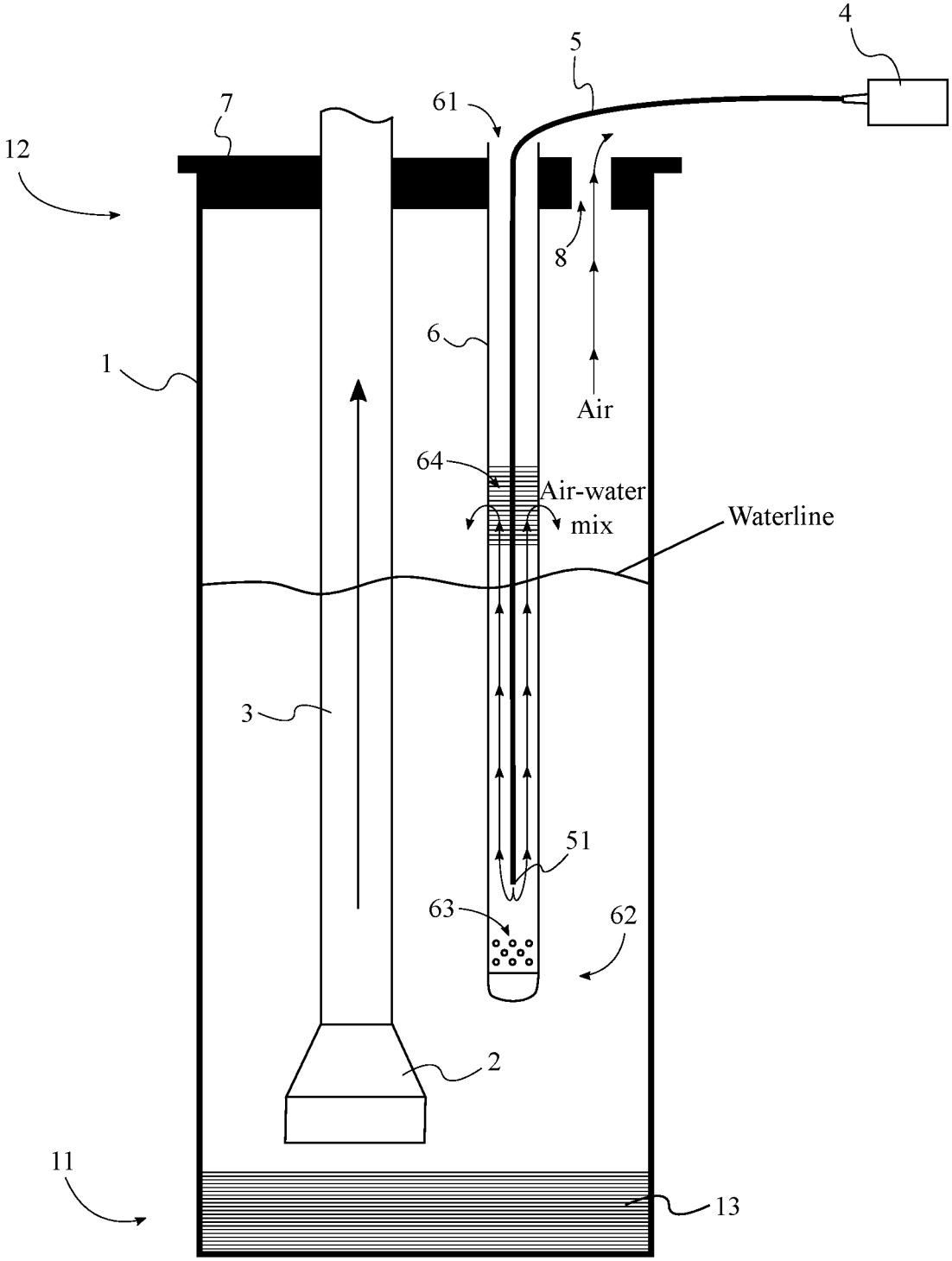
4
5
7
61
12
8
6
1
Air
64
Air-water
mix
Waterline
3
51
63
62
2
11
13

ODOR VENTING WELL PUMP SYSTEM

The current application claims a priority to the U.S. Provisional Patent application Ser. No. 62/565,663 filed on Sep. 29, 2017. The current application is filed on Oct. 1, 2018, whereas Sep. 29, 2018 and Sep. 30, 2018 were on a weekend.

FIELD OF THE INVENTION

The present invention relates generally to wells. More particularly, the present invention relates to a pumping system for wells that vents unpleasant odors from wells.

BACKGROUND OF THE INVENTION

Wells can be one of a home's main sources of water. However, natural amounts of sulfides can be found in most wells, causing an unpleasant odor. It is an object of the present invention to address this issue by providing users with a pump system that vents out the unpleasant odor from the well before the well water is pumped into the user's home.

BRIEF DESCRIPTIONS OF THE DRAWINGS

FIG. 1 is a diagram of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention.

References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole. The present invention is a pump system that functions to vent unpleasant odors out of a well and its water, so that water pumped from the well into a residence or other location is free of unpleasant odors.

In general, the preferred embodiment of the present invention comprises a well enclosure 1, a water pump 2, a water supply pipe 3, an air pump 4, an air tube 5, a venting pipe 6, a well cap 7, and an air vent 8.

As illustrated in FIG. 1, the well enclosure 1 may be any structural body with sufficient interior space to accommodate the various components of the present invention. The well enclosure 1 is installed into and below a ground surface in order to access water located below ground. In some embodiments, the well enclosure 1 may be a four-inch diameter well pipe. The well enclosure 1 comprises a water inlet to allow ground water to enter into the well enclosure 1. In the preferred embodiment, the water inlet is an outer well screen 13 traversing into the well enclosure 1 at the lower end 11 of the well enclosure 1. The well cap 7 is connected to the upper end 12 of the well enclosure 1 and generally seals the upper end 12 of the well enclosure 1, except for the various components of the present invention. More particularly, the water supply pipe 3, the venting pipe 6, and the air vent 8 traverse through the well cap 7. In various embodiments, the air vent 8 may simply be an opening, or the air vent 8 may be a component which performs a relevant function such as opening and closing.

The water pump 2 is positioned adjacent to a lower end 11 of the well enclosure 1, beneath the surface of any water which accumulates in the bottom of the well enclosure 1, thus being cable to intake the water and pump it to a desired location. In some embodiments, the water pump 2 may be a four-inch, 10-gallon, 1 horsepower sub pump, though it is noted that any water pump 2 may be utilized as desired based on preference and design choice. The water supply pipe 3 is connected to the outlet 64 of the water pump 2, and thus the water intakes the surrounding well water, and pumps the water out through the water supply pump. The water supply pipe 3 may be connected to a water line of a residence, or to any other applicable or desired destination. The water supply pipe 3 may be manufactured of any desirable material and may have various configurations in various embodiments of the present invention. The water supply pipe 3 traverses from the water pump 2 and exits the well enclosure 1 through the upper end 12 of the well enclosure 1 opposite lower end 11 of the well enclosure 1.

The venting pipe 6 traverses into the upper end 12 of the well enclosure 1, and may be generally understood to extend to a similar depth as the water supply pipe 3 within the well enclosure 1. The venting pipe 6 comprises an upper end 61, a lower end 62, an inlet 63, and an outlet 64. The inlet 63 traverses into the venting pipe 6 adjacent to the lower end 62 of the venting pipe 6, and allows well water to enter the venting pipe 6. The outlet 64 traverses into the venting pipe 6 between the upper end 61 of the venting pipe 6 and the lower end 62 of the venting pipe 6, preferably above the water line within the well enclosure 1. In the preferred embodiment, the outlet 64 of the venting pipe 6 is a well screen, through the outlet 64 may vary in different embodiments, so long as the outlet 64 allows the water/air mixture to exit the venting pipe 6 at an appropriate height within the well enclosure 1. The lower end 62 of the venting pipe 6 may be positioned adjacent to the water pump 2, or at any depth within the well enclosure 1 that allows the present invention to function properly.

The air pump 4 may be any device capable of pumping air through the air tube 5 as desired or necessary. The air pump 4 may be positioned external to the well enclosure 1, above or below ground, or in any location that permits the air pump 4 to properly function as herein described. One end of the air tube 5 is connected to the outlet 64 of the air pump 4, and the air tube 5 traverses from the air pump 4, through the venting tube into the well enclosure 1. A terminal end 51 of the air tube 5, which is where air expelled from the air pump 4 exits the air tube 5, and which is positioned opposite the air pump 4 along the air tube 5, is positioned adjacent to the lower end 62 of the venting pipe 6, wherein the air pump 4 pumps air from the air pump 4, through the air tube 5, out from the terminal end 51, and into the venting pipe 6. Preferably, the terminal end 51 of the air tube 5 is positioned close to the lower end 62 of the venting pipe 6, and more particularly, the terminal end 51 is positioned between the lower end 62 of the venting pipe 6 and the outlet 64 of the venting pipe 6.

As a result of the previously described arrangement, the air pump 4 ejects air from the terminal end 51 of the air tube 5 within the venting pipe 6, and the ejected air aerates and mixes with the water within the venting pipe 6, pushes the water upwards within the venting pipe 6. As the upwardly pushed water rises within the venting pipe 6, it exits through the outlet 64 of the venting pipe 6 and falls back into the supply of water within the well enclosure 1. Odorous gases previously contained within the well water are separated from the water due to the water being agitated with the pumped air and are now free to vent upwards out of the well enclosure 1, thus reducing or eliminating unpleasant odors from the well water before it is pumped by the water pump 2 into a residence or other destination.

Furthermore, the present invention may comprise one or more timers for controlling the operation of the air pump 4. For example, a timer may be electrically connected to the air pump 4 and set to operate such that the air pump 4 runs for 15 minutes per hour. This benefits the user by saving electricity and avoiding wear and tear on the air pump 4.

Although the invention has been explained in relation to its preferred embodiment, it is to be understood that many other possible modifications and variations can be made without departing from the spirit and scope of the invention as hereinafter claimed.

What is claimed is:

1. An odor venting water pump system comprises:
a well enclosure;
a water pump;
a water supply pipe;
an air pump;
an air tube;
a venting pipe;
the water pump being positioned adjacent to a lower end of the well enclosure;
the water supply pipe being connected to the water pump;
the water supply pipe traversing from the water pump through an upper end of the well enclosure opposite the lower end;
the venting pipe traversing into the upper end of the well enclosure;
the venting pipe comprises an upper end, a lower end, an inlet, and an outlet;
the air tube being connected to the air pump;
the air tube traversing from the air pump through the venting tube into the well enclosure;
a terminal end of the air tube being positioned opposite the air pump along the air tube;
the terminal end of the air tube being positioned adjacent to the lower end of the venting pipe, wherein the air pump pumps air from the terminal end into the venting pipe;
the inlet traversing into the venting pipe adjacent to the lower end of the venting pipe; and
the outlet traversing into the venting pipe between the upper end of the venting pipe and the lower end of the venting pipe, wherein the terminal end of the air tube is positioned between the lower end of the venting pipe and the outlet.

2. The odor venting water pump system as claimed in claim 1 comprises:
the lower end of the venting pipe being positioned adjacent to the water pump.

3. The odor venting water pump system as claimed in claim 1 comprises:
an outer well screen; and
the outer well screen traversing into the well enclosure at the lower end of the well enclosure.

4. The odor venting water pump system as claimed in claim 1 comprises:
a well cap;
an air vent;
the well cap being connected to the upper end of the well enclosure; and
the water supply pipe, the venting pipe, and the air vent traversing through the well cap.

5. The odor venting water pump system as claimed in claim 1 comprises:
the outlet of the venting pipe being a well screen.

6. An odor venting water pump system comprises:
a well enclosure;
a water pump;
a water supply pipe;
an air pump;
an air tube;
a venting pipe;
the water pump being positioned adjacent to a lower end of the well enclosure;
the water supply pipe being connected to the water pump;
the water supply pipe traversing from the water pump through an upper end of the well enclosure opposite the lower end;
the venting pipe traversing into the upper end of the well enclosure;
the venting pipe comprises an upper end, a lower end, an inlet, and an outlet;
the air tube being connected to the air pump;
the air tube traversing from the air pump through the venting tube into the well enclosure;
a terminal end of the air tube being positioned opposite the air pump along the air tube;
the terminal end of the air tube being positioned adjacent to the lower end of the venting pipe, wherein the air pump pumps air from the terminal end into the venting pipe;
the inlet traversing into the venting pipe adjacent to the lower end of the venting pipe;
the outlet traversing into the venting pipe between the upper end of the venting pipe and the lower end of the venting pipe, wherein the terminal end of the air tube is positioned between the lower end of the venting pipe and the outlet;
a well cap;
an air vent;
the well cap being connected to the upper end of the well enclosure; and
the water supply pipe, the venting pipe, and the air vent traversing through the well cap.

7. The odor venting water pump system as claimed in claim 6 comprises:
the lower end of the venting pipe being positioned adjacent to the water pump.

8. The odor venting water pump system as claimed in claim 6 comprises:
an outer well screen; and
the outer well screen traversing into the well enclosure at the lower end of the well enclosure.

9. The odor venting water pump system as claimed in claim 6 comprises:
the outlet of the venting pipe being a well screen.

10. An odor venting water pump system comprises:
a well enclosure;
a water pump;
a water supply pipe;
an air pump;
an air tube;
a venting pipe;

the water pump being positioned adjacent to a lower end of the well enclosure;

the water supply pipe being connected to the water pump;

the water supply pipe traversing from the water pump through an upper end of the well enclosure opposite the lower end;

the venting pipe traversing into the upper end of the well enclosure;

the venting pipe comprises an upper end, a lower end, an inlet, and an outlet;

the air tube being connected to the air pump;

the air tube traversing from the air pump through the venting tube into the well enclosure;

a terminal end of the air tube being positioned opposite the air pump along the air tube;

the terminal end of the air tube being positioned adjacent to the lower end of the venting pipe, wherein the air pump pumps air from the terminal end into the venting pipe;

the inlet traversing into the venting pipe adjacent to the lower end of the venting pipe;

the outlet traversing into the venting pipe between the upper end of the venting pipe and the lower end of the venting pipe, wherein the terminal end of the air tube is positioned between the lower end of the venting pipe and the outlet;

a well cap;

an air vent;

the well cap being connected to the upper end of the well enclosure;

the water supply pipe, the venting pipe, and the air vent traversing through the well cap;

the lower end of the venting pipe being positioned adjacent to the water pump;

an outer well screen;

the outer well screen traversing into the well enclosure at the lower end of the well enclosure; and the outlet of the venting pipe being a well screen.

* * * * *